US012655778B2

(12) United States Patent
Litzel

(10) Patent No.: US 12,655,778 B2
(45) Date of Patent: Jun. 16, 2026

(54) GAS EXCHANGE VALVE FOR AN INTERNAL COMBUSTION ENGINE AND INTERNAL COMBUSTION ENGINE

(71) Applicant: MAN DIESEL & TURBO SE, Augsburg (DE)

(72) Inventor: Georg Litzel, Dinkelscherben (DE)

(73) Assignee: EVERLLENCE SE, Augsburg (DE)

( * ) Notice: Subject to any disclaimer, the term of this patent is extended or adjusted under 35 U.S.C. 154(b) by 441 days.

(21) Appl. No.: 15/810,905

(22) Filed: Nov. 13, 2017

(65) Prior Publication Data

US 2018/0135476 A1 May 17, 2018

(30) Foreign Application Priority Data

Nov. 14, 2016 (DE) ..... 102016222280.5

(51) Int. Cl.
*F01L 3/08* (2006.01)
*F01L 3/02* (2006.01)
*F01L 3/22* (2006.01)

(52) U.S. Cl.
CPC *F01L 3/08* (2013.01); *F01L 3/02* (2013.01); *F01L 3/22* (2013.01)

(58) Field of Classification Search
CPC ..... F01L 3/08; F01L 3/02; F01L 3/22
See application file for complete search history.

(56) References Cited

U.S. PATENT DOCUMENTS 2,418,674 A * 4/1947 Steiner ..... F01L 3/00 123/188.6
3,162,185 A * 12/1964 Knoblock ..... F01L 3/08 123/188.6
3,742,927 A * 7/1973 Kuhn ..... F01L 3/085 123/189
3,884,210 A * 5/1975 Ferch ..... F01L 3/08 123/188.6
3,995,605 A * 12/1976 Yew ..... F02B 19/1033 123/286
3,998,199 A * 12/1976 Melchior ..... F01L 3/08 123/188.9
4,124,220 A * 11/1978 Leone ..... F01L 3/08 123/188.6

(Continued)

FOREIGN PATENT DOCUMENTS

CN 101268256 9/2008
CN 201391341 1/2010

(Continued)

OTHER PUBLICATIONS

Office Action dated Nov. 14, 2022 issued in Finnish Patent Application No. 20175976.

(Continued)

*Primary Examiner* — Kurt Philip Liethen
*Assistant Examiner* — Anthony Donald Taylor, Jr.
(74) *Attorney, Agent, or Firm* — COZEN O'CONNOR

(57) ABSTRACT

A gas exchange valve, with a valve stem carrying a valve body and a valve seat for the valve body. When closed, the valve body lies against the valve seat and when opened the valve body does not lie against the valve seat. A valve guide guides the valve stem. The valve guide has a radially inner groove that receives a separate wiping element for the valve stem.

14 Claims, 1 Drawing Sheet

(56) References Cited

U.S. PATENT DOCUMENTS 4,249,488 A * 2/1981 Siegla ..... F01L 13/0021 123/198 F
4,470,383 A * 9/1984 DeBolt ..... F01L 1/462 123/188.17
4,539,812 A * 9/1985 Rezy ..... F01N 3/34 123/41.85
4,598,674 A * 7/1986 Nono ..... F01L 1/185 123/90.41
4,606,308 A * 8/1986 Furlong ..... F02F 1/4228 123/188.14
4,612,885 A * 9/1986 Yoshikawa ..... F01L 1/0532 123/193.3
4,706,967 A * 11/1987 Ochsner ..... F16J 15/56 123/188.6
4,715,330 A * 12/1987 Buchl ..... F01L 9/04 123/90.11
4,798,181 A * 1/1989 Beer ..... F01L 3/08 123/188.9
4,811,704 A * 3/1989 Boehmer ..... F01L 3/08 123/188.6
5,016,581 A * 5/1991 Parsons ..... F01L 1/10 123/90.16
5,062,397 A * 11/1991 Larson ..... F01L 3/08 123/188.6
5,143,351 A * 9/1992 Pierce ..... B23P 19/045 123/90.67
5,255,640 A * 10/1993 Pierce ..... F01L 3/10 123/188.13
5,460,139 A * 10/1995 Marlin ..... F01L 3/08 123/188.3
5,515,821 A * 5/1996 Wolck, Jr. ..... F01L 1/46 123/188.6
5,618,048 A 4/1997 Moriarty et al.
5,645,019 A * 7/1997 Liang ..... F01L 9/20 123/90.11
5,655,493 A * 8/1997 Enright ..... F01L 3/04 123/188.11
5,732,103 A * 3/1998 Ramdani ..... B82Y 20/00 372/46.01
5,779,244 A * 7/1998 Moriarty ..... F01L 3/08 277/311
5,890,461 A * 4/1999 Iikura ..... F01P 3/14 123/41.82 R
6,006,778 A * 12/1999 Kim ..... F01L 3/08 123/188.6
6,125,810 A * 10/2000 Haselkorn ..... F01L 3/02 123/188.6
6,139,598 A * 10/2000 Narasimhan ..... B22F 1/0059 75/231
6,209,504 B1 4/2001 Hegemier et al.
6,273,045 B1 * 8/2001 Pierce ..... F01L 3/10 123/90.65
6,273,046 B1 * 8/2001 Pierce ..... F01L 3/10 123/90.67
6,883,775 B2 * 4/2005 Coney ..... F01L 1/46 123/90.12
2002/0078908 A1 * 6/2002 Washizu ..... F01L 1/0532 123/41.41
2002/0148452 A1 * 10/2002 Bircann ..... F02M 26/50 123/568.11
2006/0169942 A1 * 8/2006 Hesher ..... F01L 3/08 251/337
2007/0194260 A1 * 8/2007 Seiyama ..... F01L 3/08 251/129.15
2008/0251746 A1 * 10/2008 Riley ..... F01L 1/46 251/129.04
2009/0229560 A1 * 9/2009 Woodcroft ..... F01L 3/10 123/193.6
2011/0168123 A1 * 7/2011 Kerr ..... F01L 3/205 123/188.3
2013/0000588 A1 * 1/2013 Bartel ..... F01L 3/08 123/188.6
2013/0019831 A1 * 1/2013 Yamazaki ..... F01L 1/185 123/90.39
2013/0082203 A1 * 4/2013 Kurth ..... F01L 3/08 251/318
2015/0354727 A1 * 12/2015 Tsuneishi ..... B23P 15/002 137/340

FOREIGN PATENT DOCUMENTS

DE 1964851 A1 * 7/1971 ..... A47G 29/10
DE 3610534 10/1987
DE 19646851 2/1998
DE 102005035034 2/2007
JP 58-094802 U 6/1983
JP S 62-237017 10/1987
JP H 01-102409 U 7/1989
KR 2009-0057165 6/2009

OTHER PUBLICATIONS

Office Action dated Oct. 17, 2022 issued in Japanese Patent Application No. 2021-17219.
Office Action dated Sep. 29, 2022 issued in Korean Patent Application No. 10-2017-0144476.
Office Action dated Aug. 16, 2021 issued in Japanese Patent Application No. 2017-218034.
Office Action Dated Jun. 28, 2020 in Chinese Patent Application No. 201711118733.5.
Office Action Dated May 6, 2021 in Chinese Patent Application No. 201711118733.5.
Office Action Dated Apr. 6, 2021 in Finnish Patent Application No. 20175976.
Office Action Dated Jul. 31, 2021 in French Patent Application No. FR1760275.
Office Action Dated Jan. 25, 2021 in Japanese Patent Application No. 2017-218034.
Office Action Dated Mar. 17, 2021 in Korean Patent Application No. 10-2017-0144476.

* cited by examiner

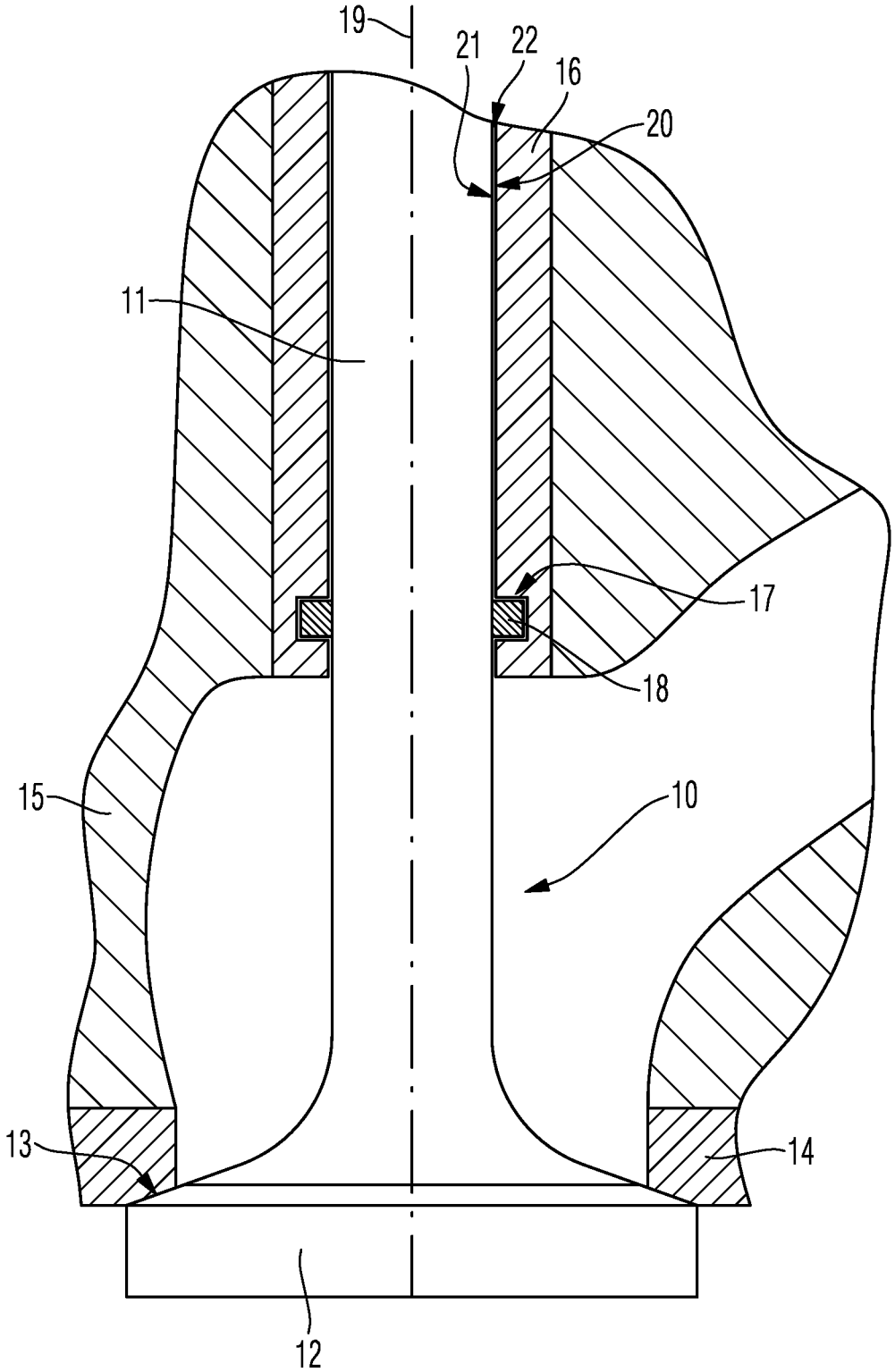
19
21
22
16
20
11
17
18
15
10
13
14
12

GAS EXCHANGE VALVE FOR AN INTERNAL COMBUSTION ENGINE AND INTERNAL COMBUSTION ENGINE

BACKGROUND OF THE INVENTION

1. Field of the Invention

The invention relates to a gas exchange valve for an internal combustion engine and to an internal combustion engine.

2. Description of the Related Art

Internal combustion engines are equipped with gas exchange valves, namely inlet-side gas exchange valves, via which cylinders of the internal combustion engine can be supplied with charge air, and exhaust-side exchange valves, via which exhaust gas can be discharged from the cylinders of the internal combustion engine.

Each gas exchange valve of an internal combustion engine is equipped with a valve stem that carries a valve body. A valve seat interacts with the valve body. For a closed gas exchange valve, the valve body lies against the valve seat whereas for an opened gas exchange valve the valve body does not lie against the valve seat.

Gas exchange valves known from practice are equipped, furthermore, with a valve guide for guiding the valve stem during the movement relative to the valve seat of the valve body received by the valve stem. A radial gap is formed between the valve guide and the valve stem. To date, valve guide and valve stem are subject to wear for example by corrosion namely due to charge air entering this radial gap or due to exhaust gas entering this radial gap. Furthermore, deposits can enter the radial gap, which can result in a valve jamming.

SUMMARY OF THE INVENTION

Starting out from this, one aspect of the present invention is based on creating a new type of gas exchange valve for an internal combustion engine and internal combustion engine with such gas exchange valves.

According to one aspect of the invention, the valve guide has a radial inner groove that receives a separate wiping element for the valve stem. With the invention it is proposed that the valve guide, namely the radial groove of the valve guide, receives a wiping element for the valve stem via which air or exhaust gas is prevented from entering the radial gap between valve guide and valve stem. It is avoided, furthermore, that deposits can enter this radial gap as a result of which the risk of valve jamming is reduced. According to one aspect of the invention, the wiping element is embodied as separate wiping element received in the groove of the valve guide. The wiping element accordingly is not an integral part of the valve guide, i.e. is not provided by a wiping edge of the valve guide, the wiping element is in fact a separate component. The valve guide is then less susceptible to wear. The separate wiping element, when worn, can be simply replaced.

Preferentially, the wiping element for the valve stem projects radially to the inside relative to the groove of the valve guide. Because of this, a particularly effective sealing of the radial gap between valve guide and valve stem is ensured while it is prevented, furthermore, that deposits can enter the region of the radial gap between valve guide and valve stem.

According to an advantageous further development, the wiping element for the valve stem is aligned concentrically to the valve stem. Because of this, the wiping element can assume a particularly effective sealing of the radial gap and particularly effectively prevent deposits entering the radial gap.

According to an advantageous further development, a groove fixes the wiping element for the valve stem in the groove seen in movement direction of the valve stem. Because of this, an exact alignment of the wiping element relative to the valve stem during operation is also ensured in order to thereby ensure an effective sealing of the radial gap and effectively prevent deposits entering the radial gap.

According to an advantageous further development, the wiping element for the valve stem consists of a metallic material. Because of this, the wiping element has an advantageous wear resistance. In particular, the hardness of the metallic material of the wiping element is lower than the hardness of the metallic material of the valve stem in order to avoid wearing of the valve stem.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings:

Preferred further developments of the invention are obtained from the subclaims and the following description. Exemplary embodiments of the invention are explained in more detail by way of the drawing without being restricted to this. There it shows:

The FIGURE is a portion of an extract from an internal combustion engine in the region of a gas exchange valve.

DETAILED DESCRIPTION OF THE PRESENTLY PREFERRED EMBODIMENTS

The FIGURE shows an extract from an internal combustion engine in a region of a gas exchange valve 10, wherein a gas exchange valve 10 and a valve stem 11 are shown, which carries a valve body 12, likewise a valve seat, which in the shown exemplary embodiment is provided by a valve seat ring 14. The valve seat ring 14 is installed in a cylinder head 15.

In particular when the gas exchange valve 10 is closed, the valve body 12 with a corresponding sealing surface lies against the valve seat 13. By contrast, in particular, when the gas exchange valve 10 is opened, the valve body 12 does not lie against the valve seat 13.

During the opening and closing of the gas exchange valve 10, the valve body 12 is moved up and down via the valve stem 11 in the direction of a longitudinal centre axis 19 of the valve stem 11. The valve stem 11 is guided in a valve guide 16. Between a surface 20 of the valve guide 16 directed radially to the inside and a surface 21 of the valve stem 11 directed radially to the outside a radial gap 22 is formed.

In particular when the gas exchange valve 10 of the FIGURE is an inlet-side gas exchange valve, the same serves for introducing charge air into a combustion chamber of a cylinder of the respective internal combustion engine. In particular when the gas exchange valve 10 is an exhaust-side gas exchange valve, the same serves for discharging exhaust gas from the respective combustion chamber of the respective cylinder of the respective internal combustion engine.

To avoid charge air or exhaust gas entering the radial gap 22 between the valve stem 11 and the valve guide 16 it is provided, according to one aspect of the invention, that in a groove 19 of the valve guide 16 directed radially to the inside and open radially to the inside a wiping element 18 for the valve stem 11 is inserted, via which this radial gap 22 can be sealed and via which deposits can be wiped off the valve stem 11 in order to prevent that such deposits enter the region of the radial gap 22 causing valve jamming there. The wiping element 18 accordingly is a separate assembly which is received in the groove 17 of the valve guide 16 and, relative to the groove 17 and thus of the surface 20 of the valve guide, projects radially to the inside.

The wiping element 18 is aligned concentrically to the valve stem 11 and seen in movement direction of the valve stem 11 is fixed in the groove 19 via the groove 17.

The separate wiping element 18, which is received in the groove 17 of the valve guide 16 preferentially consists of a metallic material with lower hardness than the metallic material of the valve stem 11.

With the invention it can be reliably prevented that exhaust gas or charge air enters the radial gap 22 between valve stem 11 and valve guide 16. Because of this, corrosion on these assemblies can be prevented in the region of the radial gap 22. It is avoided, furthermore, that deposits form in this radial gap 22 or such deposits, because of the movement of the valve stem 11, enter the radial gap 22. The risk of valve jamming is reduced. Possible wear is shifted to the separate wiping element 18, which can be easily and cost-effectively replaced.

The invention, furthermore, relates to an internal combustion engine with such gas exchange valves 10. As already explained, both the inlet-side gas exchange valves for charge air and also the exhaust-side gas exchange valves for exhaust gas can be embodied as described making reference to the FIGURE. The internal combustion engine is in particular an internal combustion engine operated with heavy fuel oil, in particular an internal combustion engine of a ship, i.e. an internal combustion engine the fuels of which can cause a deposit formation and corrosion in the region of the gas exchange valves.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A gas exchange valve comprising:

a valve body;

a valve stem carrying the valve body;

a valve seat configured to mate with the valve body, wherein a closed gas exchange valve has the valve body in contact with the valve seat and an opened gas exchange valve does not have the valve body in contact with the valve seat;

a valve guide arranged in and flush with a bore in a cylinder head and coaxially surrounding the valve stem such that a substantially constant radial gap is defined between the valve guide and the valve stem, the valve guide configured to guide the valve stem and having a radially inner groove, wherein the radially inner groove is arranged axially spaced apart from a first end of the valve guide facing the valve seat, wherein the first end of the valve guide is perpendicular to the bore in the cylinder head, and wherein an outer surface of the valve guide directly faces the cylinder head and an inner surface of the valve guide, except the radially inner groove, directly faces the valve stem; and a separate wiping element for the valve stem having a substantially rectangular cross section, which comprises a metallic material, arranged in and axially bounded by the radially inner groove of the valve guide, wherein the separate wiping element is received directly in the radially inner groove such that an outer surface of the separate wiping element directly faces the valve guide at the radially inner groove and an inner surface of the separate wiping element directly faces the valve stem.

2. The gas exchange valve according to claim 1, wherein the separate wiping element projects radially inward relative to the radially inner groove.

3. The gas exchange valve according to claim 1, wherein the separate wiping element is aligned concentrically with respect to the valve stem.

4. The gas exchange valve according to claim 1, wherein the radially inner groove fixes the separate wiping element for the valve stem in the radially inner groove as seen in a movement direction of the valve stem.

5. The gas exchange valve according to claim 1, wherein the metallic material of the separate wiping element has a lower hardness than a metallic material of the valve stem.

6. An internal combustion engine comprising:

at least one cylinder;

at least one inlet-side gas exchange valve for charge air; and at least one exhaust-side gas exchange valve for exhaust gas, wherein at least one of the at least one inlet-side gas exchange valve and the at least one exhaust-side gas exchange valve comprises:

a valve body;

a valve stem carrying the valve body;

a valve seat configured to mate with the valve body, wherein a closed gas exchange valve has the valve body in contact with the valve seat and an opened gas exchange valve does not have the valve body in contact with the valve seat;

a valve guide arranged in and flush with a bore in a cylinder head and coaxially surrounding the valve stem such that a substantially constant radial gap is defined between the valve guide and the valve stem, the valve guide configured to guide the valve stem and having a radially inner groove, wherein the radially inner groove is arranged axially spaced apart from a first end of the valve guide facing the valve seat, wherein the first end of the valve guide is perpendicular to the bore in the cylinder head, and wherein an outer surface of the valve guide directly faces the cylinder head and an inner surface of the valve guide, except the radially inner groove, directly faces the valve stem; and a separate wiping element for the valve stem having a substantially rectangular cross section, which comprises a metallic material, arranged in and axially bounded by the radially inner groove of the valve guide, wherein the separate wiping element is received directly in the radially inner groove such that an outer surface of the separate wiping element directly faces the valve guide at the radially inner groove and an inner surface of the separate wiping element directly faces the valve stem.

7. The internal combustion engine according to claim 6, wherein the internal combustion engine is configured for operation with heavy fuel oil.

8. The internal combustion engine according to claim 6, wherein the internal combustion engine is for a ship.

9. The gas exchange valve according to claim 2, wherein the separate wiping element is aligned concentrically with respect to the valve stem.

10. The gas exchange valve according to claim 1, wherein the valve seat is a separate valve seat ring arranged in the cylinder head.

11. The gas exchange valve according to claim 1, wherein an entire port side of the valve guide is flush with a surrounding port surface of the cylinder head.

12. The internal combustion engine according to claim 6, wherein an entire port side of the valve guide is flush with a surrounding port surface of the cylinder head.

13. The gas exchange valve according to claim 1, wherein a first distance between the separate wiping element and the first end of the valve guide is less than a second distance between the separate wiping element and a second end of the valve guide that is opposite the first end of the valve guide.

14. The internal combustion engine according to claim 6, wherein a first distance between the separate wiping element and the first end of the valve guide is less than a second distance between the separate wiping element and a second end of the valve guide that is opposite the first end of the valve guide.

* * * * *